US007008255B1

(12) United States Patent
Wang

(10) Patent No.: US 7,008,255 B1
(45) Date of Patent: Mar. 7, 2006

(54) ELECTRICAL CONNECTOR WITH LATCH MECHANISM

(75) Inventor: Kuo-Cheng Wang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/145,687

(22) Filed: Jun. 6, 2005

(51) Int. Cl.
*H01R 13/627* (2006.01)

(52) U.S. Cl. ..... 439/357; 439/607

(58) Field of Classification Search ..... 439/352, 439/357, 358, 372, 607, 953
See application file for complete search history.

(56) References Cited

U.S. PATENT DOCUMENTS 4,702,542 A * 10/1987 Noyes ..... 439/347
5,154,629 A 10/1992 Carver et al.
5,352,132 A * 10/1994 O'Keefe et al. ..... 439/346
5,823,812 A * 10/1998 Bhargava et al. ..... 439/345
6,146,205 A * 11/2000 Lai ..... 439/610

* cited by examiner

*Primary Examiner*—Thanh-Tam Le

(57) ABSTRACT

An electrical connector includes a dielectric body, which has at least two rows of contact receiving holes extending therethrough and a passageway defined between the two rows of contact receiving holes. A plurality of contacts are held in the contact receiving holes. A latch mechanism mounted in the passageway includes two latch arms, each of which has a hook and a force receiving portion, a pivot coupling the two latch arms together, and a spring disposed between the two latch arms. When the force receiving portions are exerted by a force, the two latch arms are pivoted to deflect the hooks from their original positions to mate with a mating connector. Thereafter, when the force is removed from the force receiving portions, the hooks urged by the spring tend to recover to their original positions to thereby fasten the mating connector.

8 Claims, 4 Drawing Sheets

ELECTRICAL CONNECTOR WITH LATCH MECHANISM

BACKGROUND OF THE INVENTION

1. Field of the Invention

This invention generally relates to an electrical connector and, particularly, to an electrical connector having a latch mechanism for connecting and releasably locking the electrical connector to a mating connector.

2. The Related Art

Referring to U.S. Pat. No. 5,154,629 issued on October 13 in 1992, a conventional electrical connector disclosed in the patent includes a cable coupled to a connector housing, which is enclosed by a molded outer housing. The outer housing has a pair of side cavities pivotally receiving a pair of latches. The latches have locking fingers for engaging a connecting element and are biased into a locking position by integral leaf springs or helical compression springs. The pivotal coupling of the latches is accomplished by protrusions on the latches retained by recesses in the housing, a pin assembly, or an integrally molded hinge.

However, the latches of the conventional connector mentioned above are arranged on two opposite sides of the connector, which occupies additional space, thereby increasing the width of the connector.

SUMMARY OF THE INVENTION

This invention is directed to solving the above problems and provides an electrical connector, which includes a dielectric body, a plurality of contacts and a latch mechanism. The dielectric body has at least two rows of contact receiving holes extending therethrough and a passageway defined between the two rows of contact receiving holes. The plurality of contacts is held in the respective contact receiving holes. The latch mechanism is mounted in the passageway, including two latch arms and a spring disposed between the two latch arms. The two latch arms are pivotally coupled, and each latch arm has a hook at a front end thereof and a force receiving portion. When the force receiving portions are exerted by a force, the two latch arms are pivoted to deflect the hooks from their original positions to mate with a mating connector. Thereafter, when the force is removed from the force receiving portions, the hooks urged by the spring tend to recover to their original positions to thereby fasten the mating connector.

In the electrical connector mentioned above, the latch mechanism is assembled in inner space of the dielectric body. Consequently, the electrical connector of the present invention can make the most of its inner space to achieve a compact width.

BRIEF DESCRIPTION OF THE DRAWINGS

A detailed explanation of preferred embodiments of the present invention will be given, with reference to the attached drawings, for better understanding thereof to those skilled in the art.

DETAILED DESCRIPTION OF THE PREFERRED EMBODIMENTS

Figure 1:
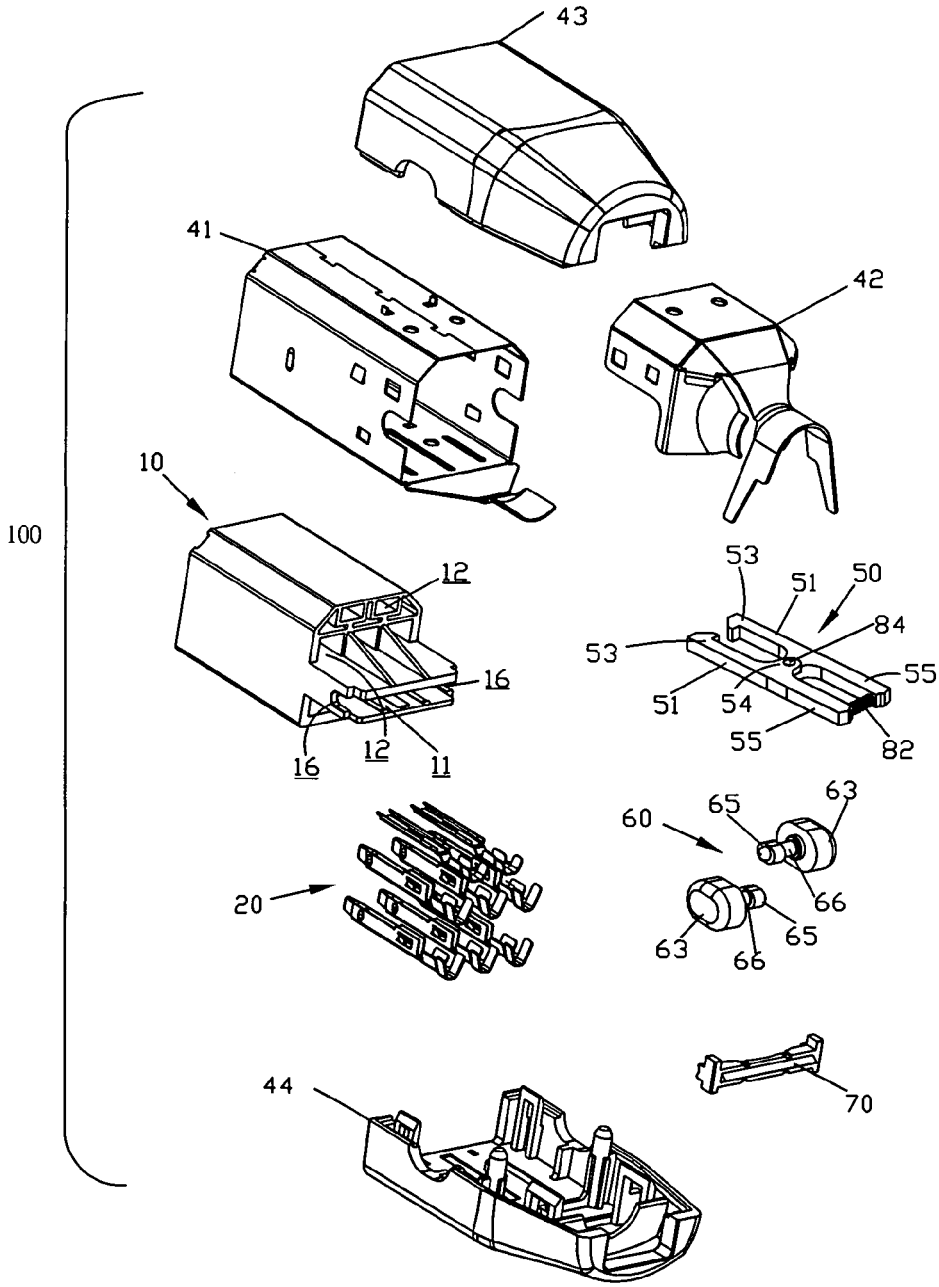
FIG. 1 is an exploded view of an electrical connector in accordance with the present invention.
Figure 2:
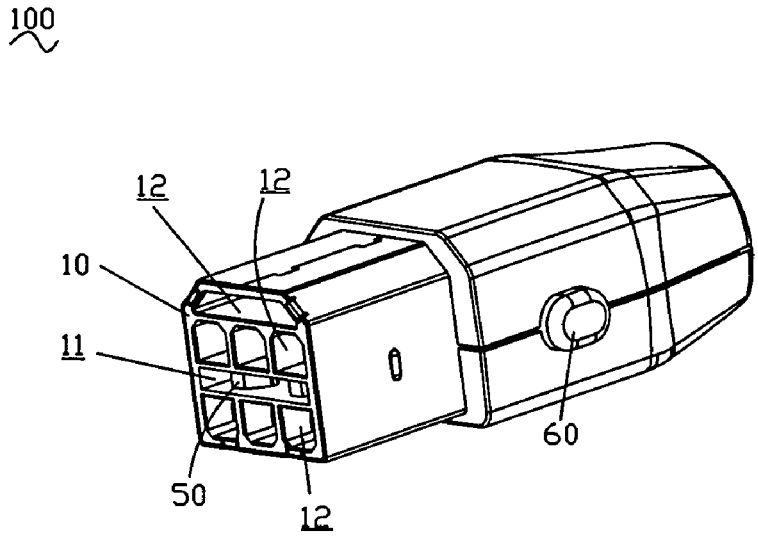
FIG. 2 is a perspective view of the electrical connector shown in FIG. 1.

With reference to FIGS. 1 and 2, an electrical connector 100 in accordance with the present invention comprises a dielectric body 10, a plurality of contacts 20 held in the dielectric body 10, a primary metal shield 41 and a secondary metal shield 42 encircling the dielectric body 10, and an upper dielectric cover 43 and a lower dielectric cover 44 clasping the dielectric body 10.

As shown in FIG. 1, the dielectric body 10 defines a plurality of contact receiving holes 12 and a passageway 11 therein, which all extend through the dielectric body 10 front to rear. The contact receiving holes 12 are arranged in three (upper, middle and lower) rows for correspondingly holding three (upper, middle and lower) rows of contacts 20 therein. The passageway 11 is located between the middle row and the lower row of the contact receiving holes 12 for receiving the latch mechanism 50 therein. The dielectric body 10 forms three protrusions 15 in the passageway 11 for positioning the latch mechanism 50 (shown in FIG. 3). The dielectric body 10 further includes two recesses 16 which are respectively defined in two opposite side walls of the dielectric body 10. Each of recesses 16 laterally communicates the passageway 11 with outside, and each of the recesses 16 has a rear opening.

Figure 4:
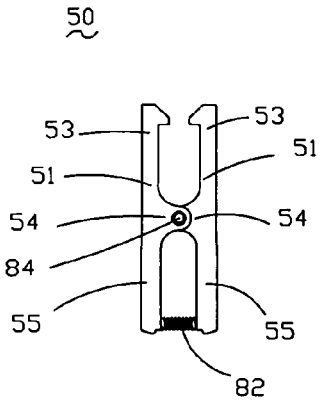
FIG. 4 is a perspective view of a latch mechanism of the electrical connector according to a first embodiment of the present invention.
Figure 5:
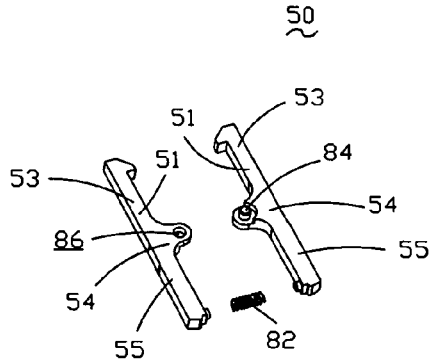
FIG. 5 is an exploded view of the latch mechanism shown in FIG. 4.

FIG. 4 and FIG. 5 show a first embodiment of the latch mechanism 50 according to present invention. The latch mechanism 50 includes two latch arms 51. The middle portion of each latch arm 51 protrudes inwardly to form a coupling portion 54, and the front end of each latch arm 51 protrudes inwardly to form a hook 53. In this embodiment, the coupling portion 54 of one latch arm 51 integrally forms a pivot 84; correspondingly, the coupling portion 54 of the other latch arm 51 defines an aperture 86 for pivotally engaging with the pivot 84. With overlapping the two coupling portions 54 together and mounting the pivot 84 in the aperture 86, the two latch arms 51 are pivotally coupled together. A portion behind the coupling portion 54 of each arm 51 acts as a force receiving portion designated 55. The latch mechanism 50 further includes a helical spring 82 disposed between the rear ends of the two latch arms 51.

Figure 6:
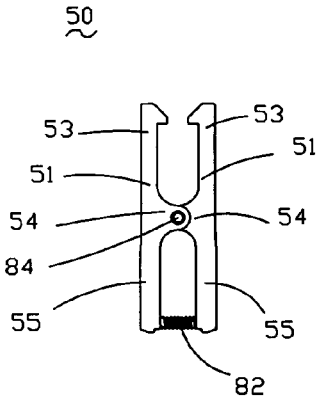
FIG. 6 is a perspective view of a latch mechanism of the electrical connector according to a second embodiment of the present invention.
Figure 7:
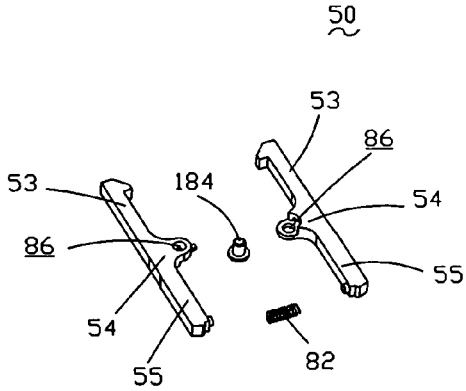
FIG. 7 is an exploded view of the latch mechanism shown in FIG. 6.

Please refer to FIGS. 6 and 7, a second embodiment of the latch mechanism 50 is provided according to present invention. In this embodiment, a pivot 184 is formed as a separate piece, which can replace the pivot 84 in the first embodiment and perform similar function as the pivot 84 acting in the first embodiment.

The latch mechanism 50, either mentioned in the first embodiment or the second embodiment, is used for releasably locking with a mating connector. When the force receiving portions 55 are exerted by an external force to relatively move inwardly, the two latch arms 51 are pivoted to deflect the hooks 53 from the original position to an open position so as to mate with a mating connector. Simultaneously, the spring 82 is gradually compressed and generating an elastic force to resist the relative movement of the two latch arms 51. Thereafter, when the external force is removed from the force receiving portions 55, the two latch arms 51 are pivoted by the elastic force of the spring 82, and the hooks 53 urged by the elastic force tend to recover to the original position to thereby fasten the mating connector.

Referring to FIG. 1, the electrical connector 100 further includes a pair of buttons 60. Each of the buttons has a pressing head 63, a pushing foot 65, and a propping neck 66 connecting the pressing head 63 and the pushing foot 65 together.

Referring to FIG. 1 again, the electrical connector 100 further includes a stopper 70. The stopper 70 shaped as a strip is used for sealing the end of the passageway 11 and the rear opening of the recesses 16.

Figure 3:
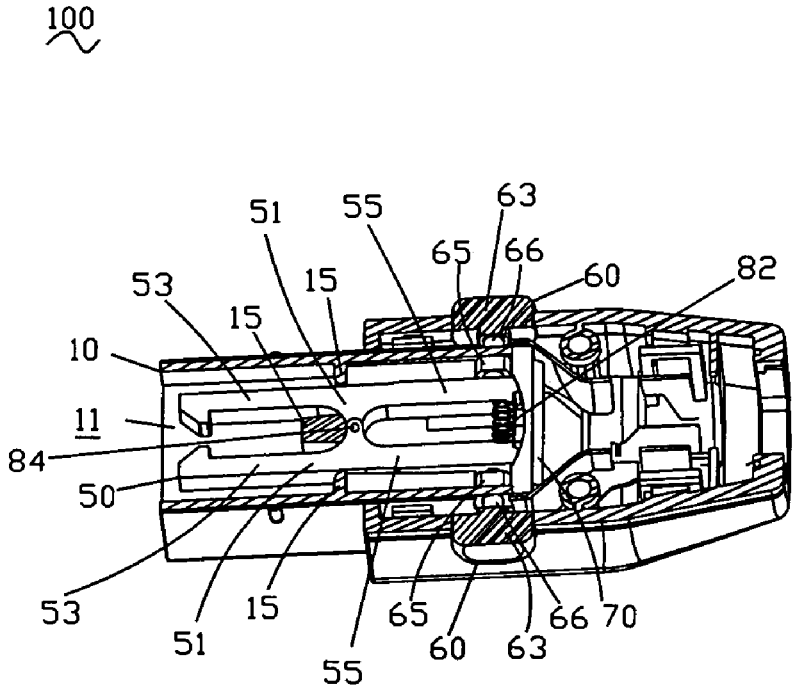
FIG. 3 is a cross-sectional view of the electrical connector.

Please refer to FIGS. 2 and 3, in assembling of the electrical connector 100, firstly the contacts 20 are inserted into the dielectric body 10 and held in the contact receiving holes 12. Then the mechanism 50 is mounted in the passageway 11 of the dielectric body 10 and positioned by the protrusions 15 so as to keep the latch mechanism 50 as an integrated element from onward, rightward and leftward movement relative to dielectric body 10. Thereafter, the propping neck 66 of each button 60 is retained in the corresponding recess 16 with the pressing head 63 exposed to outside of the dielectric body 10 and the pushing foot extending into in the passageway 11 for touching with the force receiving portions 55 of the latch mechanism 50. The stopper 70 is infixed into the end of the passageway 11 and seals the rear opening of each recess 16 so as to keep the latch arms 51 of the latch mechanism 50 and the buttons 60 from rearward movement. Finally, the dielectric body 10 is covered by the primary metal shield 41 and the secondary metal shield 42 and clasped by the upper dielectric cover 43 and the lower dielectric cover 44.

In the electrical connector 100 according to the present invention, the buttons 60 are used to cooperate with the latch mechanism 50 for transmitting an external force acted on the pressing heads 63 to the force receiving portions 55 of the latch mechanism 50 by the pushing feet 65 touching with the force receiving portions 55. As using, when the pressing heads 63 are pressed, the pressing force is transmitted to the force receiving portions 55, thereby the two latch arms 51 are pivoted to deflect the hooks 63 from their original positions to mate with a mating connector. When the external force is removed from the pressing heads 63 of the buttons 60, the hooks 53 urged by the spring 82 tend to recover to the original positions to thereby fasten the mating connector.

It can be seen from the mentioned above that, the latch mechanism 50 is assembled in inner space of the electrical connector 100 to make the most of the inner space of the electrical connector 100, thereby the electrical connector 100 achieves a compact width.

Although preferred embodiments of the present invention have been described in detail hereinabove, it should be clearly understand that many variations and/or modifications of the basic inventive concepts herein taught which may appear to those skilled in the present art will fall within the spirit and scope of the present invention, as defined in the appended claims.

What is claimed is:

1. An electrical connector comprising:

a dielectric body having at least two rows of contact receiving holes extending therethrough and a passageway defined between the two rows of contact receiving holes;

a plurality of contacts held in the respective contact receiving holes; and a latch mechanism mounted in said passageway, including two latch arms and a spring disposed between the two latch arms, the two latch arms being pivotally coupled, each latch arm having a hook at a front end thereof and a force receiving portion, wherein when the force receiving portions are exerted by a force, the two latch arms are pivoted to deflect the hooks from their original positions to mate with a mating connector, thereafter, when the force is removed from the force receiving portions, the hooks urged by the spring tend to recover to their original positions to thereby fasten the mating connector.

2. The electrical connector as claimed in claim 1, wherein each of said two latch arms has a coupling portion protruding from the middle portion thereof, said two latch arms are pivotally coupled at the coupling portions, and said force receiving portion of each latch arm is located behind the coupling portion.

3. The electrical connector as claimed in claim 2, wherein the coupling portion of one latch arm integrally forms a pivot, and the coupling portion of the other latch arm defines an aperture for pivotally engaging with the pivot.

4. The electrical connector as claimed in claim 2, wherein the latch mechanism further includes a pivot, and the two coupling portions each define an aperture for pivotally engaging with the pivot.

5. The electrical connector as claimed in claim 1, wherein the dielectric body defines two recesses in opposite sides thereof communicating with the passageway, the electrical connector further includes two buttons mounted on the dielectric body, each button has a pressing head exposed to outside of said dielectric body, a pushing foot extending into the passageway for touching with the corresponding force receiving portion of the latch arm, and a propping neck retained in the corresponding recess, the force is exerted on the force receiving portion by pressing the pressing head.

6. The electrical connector as claimed in claim 5, further including a stopper infixed in the end of said passageway and sealing the rear opening of said recesses for retaining said latch arms and said buttons.

7. The electrical connector as claimed in claim 1, further including a primary metal shield and a secondary metal shield encircling the dielectric body.

8. The electrical connector as claimed in claim 1, further including an upper dielectric cover and a lower dielectric cover clasping the dielectric body therebetween.

* * * * *